United States Patent [19]

Haüshofer et al.

[11] Patent Number: 4,601,943

[45] Date of Patent: Jul. 22, 1986

[54] FIRE PROOFING WEB WITH VAPOR BARRIER

[76] Inventors: Bert Haüshofer, Achim-von-Arnim-Strasse 28, D-5300 Bonn 1; Karl Serwane, D-6902 Sandhausen, both of Fed. Rep. of Germany

[21] Appl. No.: 800,642

[22] PCT Filed: Mar. 15, 1985

[86] PCT No.: PCT/DE85/00087

§ 371 Date: Nov. 4, 1985

§ 102(e) Date: Nov. 4, 1985

[87] PCT Pub. No.: WO85/04209

PCT Pub. Date: Sep. 26, 1985

[30] Foreign Application Priority Data

Mar. 17, 1984 [DE] Fed. Rep. of Germany ..... 3409897

[51] Int. Cl.[4] ..... B32B 15/08; B32B 17/06; E04B 1/94; E04C 2/26

[52] U.S. Cl. ..... 428/246; 428/285; 428/484; 428/920; 428/921

[58] Field of Search ..... 428/246, 254, 285, 484, 428/920, 921

[56] References Cited

U.S. PATENT DOCUMENTS 4,310,587 1/1982 Beaupre ..... 428/246

FOREIGN PATENT DOCUMENTS 1096104 2/1981 Canada .
27750 4/1981 European Pat. Off. .
2902283 7/1980 Fed. Rep. of Germany .
3220821 12/1983 Fed. Rep. of Germany .
1190913 4/1959 France .
2145709 2/1973 France .
WO83/01081 3/1983 PCT Int'l Appl. .

*Primary Examiner*—William J. Van Balen
*Attorney, Agent, or Firm*—David A. Jackson; Daniel H. Bobis

[57] ABSTRACT

The fire proofing web is laid on a roof surface, in addition to the usual roof and insulating webs. It is intended to suppress or at least delay the occurrance of surface fires covering an area. At the same time, it is intended to form a vapor barrier. For that purpose, it includes, as the carrier web, an aluminium foil between two plastic foils. A glass fiber fleece with a content of crystalline-bound water is applied to a plastic foil as a lining thereon. In the event of a fire, the water evaporates and the resulting water vapor prevents or delays a surface fire or fire penetration.

4 Claims, 3 Drawing Figures

FIRE PROOFING WEB WITH VAPOR BARRIER

FIELD OF THE INVENTION

The invention relates to a fire proofing web with vapour barrier for covering roof and wall surfaces and the like comprising a carrier web and a flame proofing web which is applied thereto, comprising a glass fibre fleece with a content of crystalline-bound water.

STATE OF THE ART

Webs which are referred to as fire proofing webs are applied to roof structures and webs which do not constitute a 'hard roofing' within the terms of German Industrial Standard (DIN) 4102 and which are therefore not resistant to flying or air-borne fire and radiant heat. Such fire proofing webs provide the desired 'hard roofing'. The fire proofing webs are laid between the barrier or insulating material and a top layer. They are primarily used in the case of plastic foils or high-polymer webs. An example in respect of a 'hard roofing' which is attained in that way is described in German laid-open application (DE-OS) No. 32 20 821.

It has also already been proposed (German patent application No. P 33 22 283.5) for flat roofs to be protected from fire from above by a fire proofing coating agent which contains elastomer bitumen. That fire proofing coating has a similar effect to a gravel or grit fill.

In relation to roofs and flat roofs, particularly when large areas are to be covered, a shaped steel plate is frequently used as a substructure. EPS-hard foam is predominantly used in that construction as an insulating or barrier material, for reasons concerned with the physical aspects of building. In that term, EPS denotes expanded polystyrene which is a thermoplastic material. Such plastic foam represents the optimum solution in regard to wind load, absorption of moisture, elasticity, good value and a good laying capability.

From tests carried out by IVH, Industrieverband Hartschaum eV, Heidelberg, and the North Rhine-Westphalia region, it is known that thermoplastic materials which are laid on shaped steel plates, as barrier or insulating materials, have a particularly advantageous behaviour in the initial phase of a fire. In the initial phase of a fire, they undergo sintering or flow and thereby absorb heat, thereby delaying the transmission of heat to the steel plate. It is stated in that respect that the temperature flows away upwardly. When the fire continues the roof skin however becomes increasingly heavily loaded. After the barrier or insulating material has burnt away or disappeared, the temperature strikes through. If the fire is allowed to continue for a prolonged period of time, the fire can burn through over an area of the roof. In the final phase of the fire when the steel plate collapses, it is then irrelevant whether the barrier material used was a melting thermoplastic material or a non-melting material.

In order to provide good endurance in respect of the middle phase of a fire, being a phase which occurs comparatively frequently, barrier or insulating materials comprising a non-melting material are being increasingly used. In the United States of America for example plasterboard panels or boards are laid on the shaped steel plates and EPS-boards are additionally laid on the plasterboard boards. That is effected in two working operations so that it is comparatively expensive. Furthermore, in order to comply with the requirements regarding the physical aspects of building, a vapour barrier generally has to be provided beneath the plasterboard panels.

It is also known for an aluminum foil which is coated with bitumen on both sides to be laid as a vapour barrier on the shaped steel plate. However, due to the bitumen coating, that foil construction burns easily and does not contribute to a fire proofing effect.

BRIEF DESCRIPTION OF THE INVENTION

Taking the foregoing considerations as the basic starting point, the object of the present invention is that of developing a roof web which forms both a fire proofing web and also a vapour barrier. In that connection, the fire proofing web should be such that in the event of a fire from below, the structure reliably prevents the fire from burning through until the shaped steel plate collapses. In a fire proofing web of the general kind set forth in the opening part of this specification, that object is attained, in accordance with the invention, in that the carrier web is an aluminum foil, plastic foils are applied on both sides of the aluminum foil, the glass fibre fleece which has a content of crystalline-bound water is applied to one of the plastic foils and is coated with a layer of wax on its free surface. The glass fibre fleece which contains the crystalline-bound water is for example as set forth in German laid-open application (DE-OS) No. 32 20 821. The fire proofing web according to the invention, with vapour barrier, is laid over the supporting roof construction, for example the shaped steel plate structure, and under the web of insulating material.

In an advantageous embodiment, the layer of wax which is applied to the free surface of the glass fibre fleece is water-repellant but previous to water vapour. That ensures that the water which is crystalline-bound in the glass fibre fleece or the fire proofing agent is not washed out while it is being laid on the building site. That feature provides adequate moisture-proofing for the laying time on site. It should be mentioned in that connection that, after having been laid, the fire proofing web according to the invention can and should be immediately covered with other webs.

Desirably, the plastic foil which is provided on the underside of the aluminum foil as a lining layer thereon comprises polyester while the plastic foil which is on the top side as a lining thereon comprises polyethylene.

When the fire proofing web according to the invention is laid on a shaped metal plate structure, the spaces in the shaped metal plate which then remain free can be partitioned off. For that purpose, bars or cubes of plastic foam can be put into the above-mentioned spaces. The bars or cubes close off the shaped portions or corrugations of the shaped plate. In that way, combustible gases, smoke and the like are prevented from flowing on and being spread around. Desirably, the rods, bars or cubes consisting of a plastic foam are impregnated with a fire proofing agent. The use of such bars or cubes of plastic foam for closing the hollow spaces or corrugations of the shaped plates is known per se. However, the use of such cubes or bars in relation to the fire proofing web according to the invention is novel. It is also novel for the cubes or bars to be treated or impregnated with a fire proofing agent. Instead of using plastic foam, the spaces remaining in the shaped plate structure may also be partitioned off using sand or gravel. Such material is simply shaken into the spaces to be partitioned.

The fire proofing web according to the invention has a high level of tearing strength. It can therefore be laid on shaped steel plates or steel plates or trapezoidal section and over the corrugations thereof. It is protected from corrosion by the thin polyethylene foils. The fire proofing web according to the invention may be stuck in position by means of a bitumen cold adhesive which itself brings only a few combustible constituents on to the roof. The overlaps between adjacent fire proofing webs can also be glued in position using a bitumen cold adhesive. When there are particular fire proofing requirements, the fire proofing web can also be nailed in place. In that connection, the entire pack or array or layers, including the first layer of the roof skin, is nailed in position.

In the case of a fire from below, the fire proofing web which is in an upward position gives off about 200 grams of water per square meter, as a result of the water which is crystalline-bound in the glass fibre fleece. That gives rise to large amounts of water vapour. The cavities in the thermoplastic material which have been formed due to the effect of heat from below are filled with the above-mentioned water vapour to such a degree that the fire can no longer burn through.

As stated, the fire proofing web according to the invention may be laid directly on shaped steel plates such as steel plates of trapezoidal section. Likewise, it can also be laid on other substructures which need to be fire-proofed. In that respect, it forms the vapour barrier which is required for reasons concerned with the physical aspects of building, and, as stated, at the same time prevents a fire from burning through.

DESCRIPTION OF THE DRAWING

The fire proofing web will now be further described with reference to the example of the embodiment shown in the drawing in which.

DESCRIPTION OF AN EMBODIMENT

Figure 1:
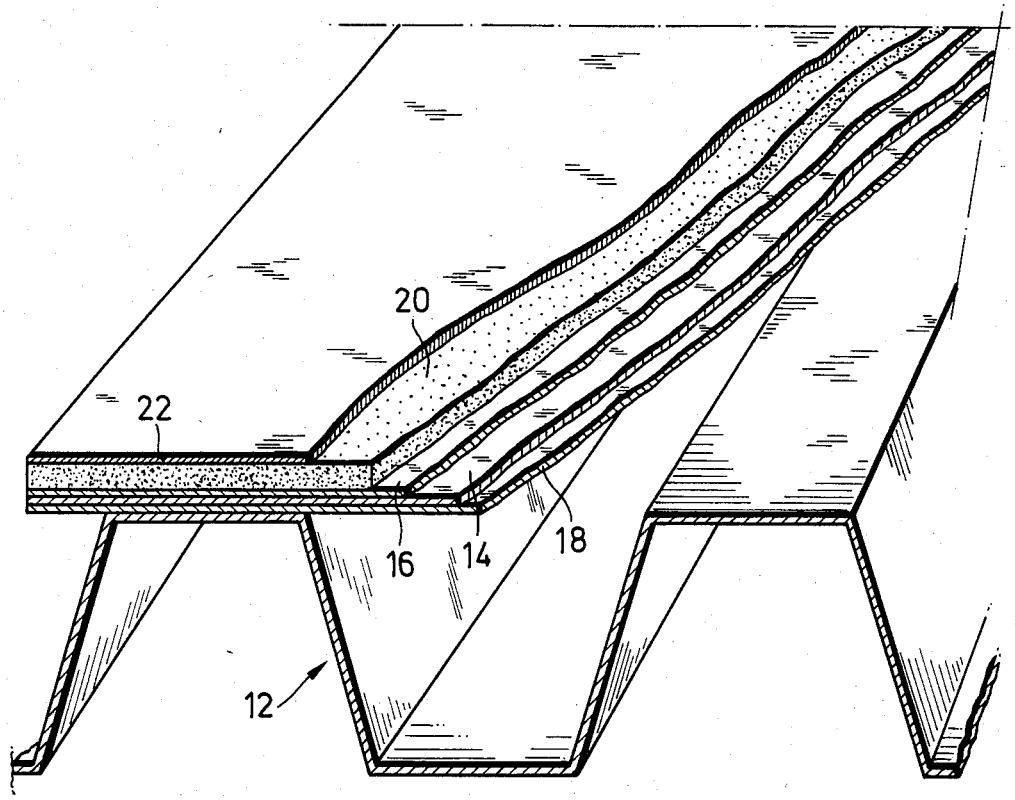
FIG. 1 is a perspective view, not to scale, of the fire proofing web, the webs being shown in broken-away form for greater clarity of the drawing.

FIG. 1 shows the shaped steel plate 12 which is a plate of trapezoidal section. The fire proofing web according to the invention is disposed thereon, including the aluminum foil 14 and the plastic foils or films 16 and 18 which are applied thereto on both sides thereof. The glass fibre fleece 20 is applied to the upward plastic foil or film 16. The fleece 20 is treated with a fire proofing agent and/or enriched with crystalline-bound water. A thin layer of wax 22 is disposed on the glass fibre fleece 20. The spaces or corrugations in the trapezoidal plate 12 are denoted by reference numeral 24.

Figure 2:
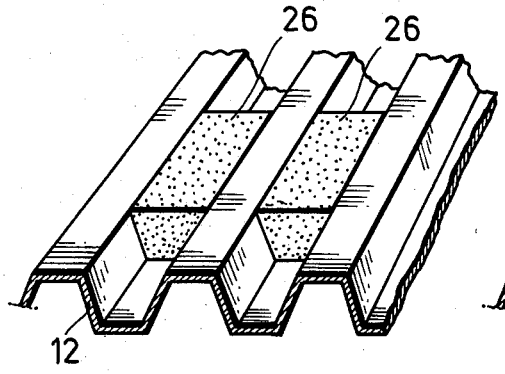
FIG. 2 is a perspective view on another scale of the steel plate of trapezoidal section used, with inserted bars or rods of plastic foam.
Figure 3:
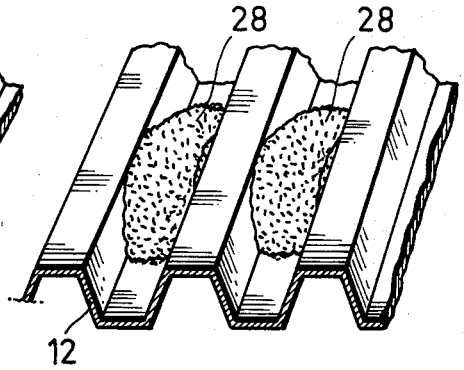
FIG. 3 is a view corresponding to that shown in FIG. 2, with a sand fill therein.

In the view shown in FIG. 2, cubes or bars 26 of plastic foam lie in the corrugations. The plastic foam may be expanded polystyrene (EPS). The bars may also be treated with a fire proofing agent or may contain crystalline-bound water. As stated, they ensure that, in the event of a fire, smoke and combustible gases cannot flow through the corrugations 24 and thus become distributed through the building and the roof structure. In the view shown in FIG. 3, small heaps 28 of gravel or grit or sand are introduced into the corrugations.

We claim:

1. A fire proofing web with vapor barrier for covering roof and wall surfaces and the like comprising a carrier web and a flame proofing web which is applied thereto, comprising a glass fiber fleece with a content of crystalline-bound water, characterized in that the carrier web is an aluminum foil (14), plastic foils (16, 18) are applied to both sides of the aluminum foil (14), and the glass fiber fleece (20) which has a content of crystalline-bound water is applied to one (16) of the plastic foils and is coated with a layer of wax (22) on its free surface.

2. A fire proofing web according to claim 1 characterised in that the layer of wax (22) is water-repellant and pervious to water vapour.

3. A fire proofing web according to claim 1 characterised in that the plastic foil (18) which is applied to the underside of the aluminum foil (14) comprises polyester.

4. A fire proofing web according to claim 1 characterised in that the plastic foil (16) which is applied to the top side of the aluminum foil (14) comprises polyethylene.

* * * * *